US005947466A

United States Patent [19]

Romine

[11] Patent Number: 5,947,466

[45] **Date of Patent: *Sep. 7, 1999**

[54] CONTINUOUS BELT DRIVE PAPER FEED SYSTEM

[75] Inventor: Michael J. Romine, Escondido, Calif.

[73] Assignee: Hewlett-Packard Company, Palo Alto, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 08/946,296

[22] Filed: Oct. 7, 1997

[51] Int. Cl.[6] ..... B65H 3/04

[52] U.S. Cl. ..... 271/34; 271/35; 271/121; 271/167; 271/10.06; 271/127

[58] Field of Search ..... 271/34, 35, 121, 271/167, 10.06, 127

[56] References Cited

U.S. PATENT DOCUMENTS

| | | | |
|---|---|---|---|
| 3,035,834 | 5/1962 | Bottrell | 271/34 |
| 3,749,395 | 7/1973 | Bazzarone et al. | 271/34 |
| 3,768,803 | 10/1973 | Stange | 271/34 |
| 3,966,189 | 6/1976 | Taylor et al. | 271/167 |
| 4,526,358 | 7/1985 | Ura et al. | 271/34 |
| 4,572,498 | 2/1986 | Shiozawa | 271/167 |
| 5,114,134 | 5/1992 | Rasmussen et al. | 271/34 |

FOREIGN PATENT DOCUMENTS

| | | | |
|---|---|---|---|
| 358036835 | 3/1983 | Japan | 271/34 |
| 0039640 | 3/1984 | Japan | 271/34 |
| 0244833 | 10/1987 | Japan | 271/34 |

*Primary Examiner*—William E. Terrell
*Assistant Examiner*—Wonki K. Park
*Attorney, Agent, or Firm*—Jerry R. Potts

[57] ABSTRACT

A paper feed apparatus for low profile printer including a rotatable paper feed drive shaft which is mounted for rotation in a printer housing which supports a first belt drive pulley or roller. The belt drive pulley engages a continuous belt mounted thereon of rubber or other flexible belt material. A paper supply tray having paper is selectively biased against the belt with the paper in contact therewith. The opposite end of the continuous belt is mounted to a idler roller or roller on a rotatable idler shaft which supports the continuous belt such that the 1 portion of said belt between the drive pulley and the idler roller which is in contact with the paper is disposed generally, (the belt run) to a paper path. On motion of the belt at least one sheet of paper is moved out of the paper supply tray. An inclined paper separator is mounted below the termination belt shaft and is selectively biased against the continuous belt at a point on the belt between the drive roller and the idler roller. The paper separator is angled away from the paper source and upwards toward the lower surface of the continuous belt and has an engagement pad of rubber or other material similar to the belt with an arcuate crown for engaging said belt. The belt material has a greater friction than the separator pad. However the separator pad and belt each have sufficient friction to prevent relative movement of paper in contact therewith. The uppermost sheet of paper is moved along a paper path through the separator to other parts of the printer. When the paper is engaged by the other operative parts of the printer the bias is removed and the rotation of the belt is interrupted.

20 Claims, 7 Drawing Sheets

CONTINUOUS BELT DRIVE PAPER FEED SYSTEM

BACKGROUND OF THE INVENTION

1. Field of the Invention

This invention relates to paper feed devices which are part of printers and copiers. More specifically, this invention relates to sheet paper feed devices which move single sheets of paper into copy or print positions.

2. Related Art

The art is replete with various paper feed apparatus included in printers and copiers. Most are of a roller type which feeds paper into position for printing. Such related art systems are prone to multi-feeds or misfeeds of paper sheets. In addition, such systems often use relatively large diameter rollers of 2 inches or more to push the paper through the system. A pad is wrapped partially around the roller and retards all but one sheet. The large drive roller or wheel impacts space constraints in the printer and paper that is pushed rather than pulled through a printer can buckle or move in a direction other than where in intended.

The classic paper separation system is a corner separation system as used in typical copy machines. Such systems are limited essentially to standard paper widths and are unable to feed heavier paper widths. Another related art system uses an inclined separator pad mounted on the frame of a separator disposed in the paper path to retard all but one sheet. Such systems can be optimized only for a certain range of sheet media and are very sensitive to separator pad angle.

In addition, such related art systems also tend to misalign paper sheets as they are fed through the system resulting in wrinkles sheets or misaligned print and are prone to buckling and stalling of the paper as it feeds through the system due to misalignment of the leading edge against rollers or guides through the various stages of feed.

As the related art systems age, that is suffer normal wear, the tolerances change and feed problems increase.

Some belt feed patents have also been issued. Such systems are typified by U.S. Pat. No. 5,114,134 to RASMUSSEN. The RASMUSSEN patent has a paper guide of cork which is substantially the width of the paper on which three, roller driven belts pull paper from the paper tray over the cork for separation. Due to the expanse of area covered by the belts and cork and the pull on the paper by the several belts, friction and pressure within the system are significantly increased with a concurrent increase in wear.

SUMMARY OF THE INVENTION

This invention is a paper feed apparatus for a low profile printer, although it is suitable for any printer copier or any other devices which requires paper or other sheet material to be fed through a system. The paper feed apparatus includes a rotatable paper feed drive supporting a belt drive pulley. The belt drive pulley engages a continuous belt mounted thereon which may be rubber or other flexible belt material. The opposite end of the continuous belt is mounted to an idler roller on a rotatable idler shaft which supports the continuous belt such that a portion of said belt between the belt drive pulley and the idler roller is disposed generally parallel to a desired paper path, that is, a generally linear path from a paper source to a moveable individual sheet separator mounted below the belt when the same is biased against the belt as describe below. While this invention is described in terms of paper and paper sheets, any sheet material may be handled including individual or continuous sheets of such sheet material. The sheet separator is provided with a separator pad that has an inclined section which merges into an arcuate crown at the point of contact with the belt, i.e. a Normal Interface Point (NIP) when the separator pad is biased into the belt, and terminates in a declined section. The paper is selectively biased against the belt at one point and the separator pad is selectively biased against the belt at the NIP downstream of the paper at a point on the belt between the drive pulley and the idler roller. The inclined surface of the separator pad is angled away from the paper source and upwards toward the lower surface of the continuous belt and has an engagement surface of rubber or other material similar to the belt on the top thereof for engagement with the continuous belt. The belt material and the separator pad each have sufficient friction to prevent relative movement of paper in contact therewith. In addition, the coefficient of friction of the belt against a sheet of paper should be sufficient to overcome the friction of that same sheet when it is in contact with the separator pad as the paper is moved toward a printing station.

The particular technology used to effect printing on the paper at the printing station is not the subject of this invention, as the instant invention may be used in any sheet feeding or separating device. Alternatively, while an individual sheet paper feed device is described, continuous feed paper could also be fed using the continuous belt described herein and paper separation would not be required.

The paper feed apparatus is operatively engaged with a motive apparatus through gears and the like which are not shown and which are within the skill of the art. The belt may be selectively moved and stopped as required.

For feeding single sheets a paper tray holding a paper supply of individual sheets mounted in the printer such that the paper in the tray may be selectively biased against the belt at an infeed point by operation of a solenoid or other apparatus. The paper is biased so that the leading edge thereof extends into the paper path below the continuous belt.

When the paper feed operation commences, the paper tray is raised to bias the paper supply against the continuous belt and the belt commences movement on rotation of the paper feed shaft. An initial top sheet of paper is pulled from the paper tray and toward the paper separator pad along the paper path until it reaches the separator pad. It is possible that due to the friction between sheets of paper, additional sheets will be pulled along with the top sheet. At the same time that the paper is biased against the belt, the paper separator pad is also biased against the belt. Continued movement of the belt will cause the leading edge of each the initial top sheet and each bottom sheet to engage the inclined section of the paper separator pad, commencing with the lowermost sheet engaging the paper separator pad first and then each subsequent sheet from the bottom to the top sheet sequentially thereafter. The friction of the leading edge of each bottom sheet against the separator pad is greater than between it and the upper sheet and causes each subsequent bottom sheet to cease movement with the belt movement. The friction against the upper most sheet which is contact with the belt causes the uppermost sheet to be pulled through the NIP and move toward the grit wheel or other downstream paper collection device. As each lower sheet moves into the separation pad, it is held in place by the friction of the pad being greater than the friction of the paper to paper interface. This causes the upper most sheet to be separated from any lower sheets and thus a single sheet is fed to a grit wheel or the like for further processing in the printer. Because the upper section of the separator pad is arcuate, there is also a region of overlap on the declined side of the separator pad. The action of the pad against the lower sheets on the declined side is identical to that on the source side of the separator pad because the overlap of the belt forces the lower sheets against the separator pad and overcomes the paper to paper friction between upper and lower sheets.

When the separated sheet engages the grit wheel, the bias of the paper supply against the belt and the bias of the separator pad against the belt is released. Any sheets which have reached the separator are returned to the tray by kicker or paper return mechanism.

PREFERRED EMBODIMENT

Figure 1:
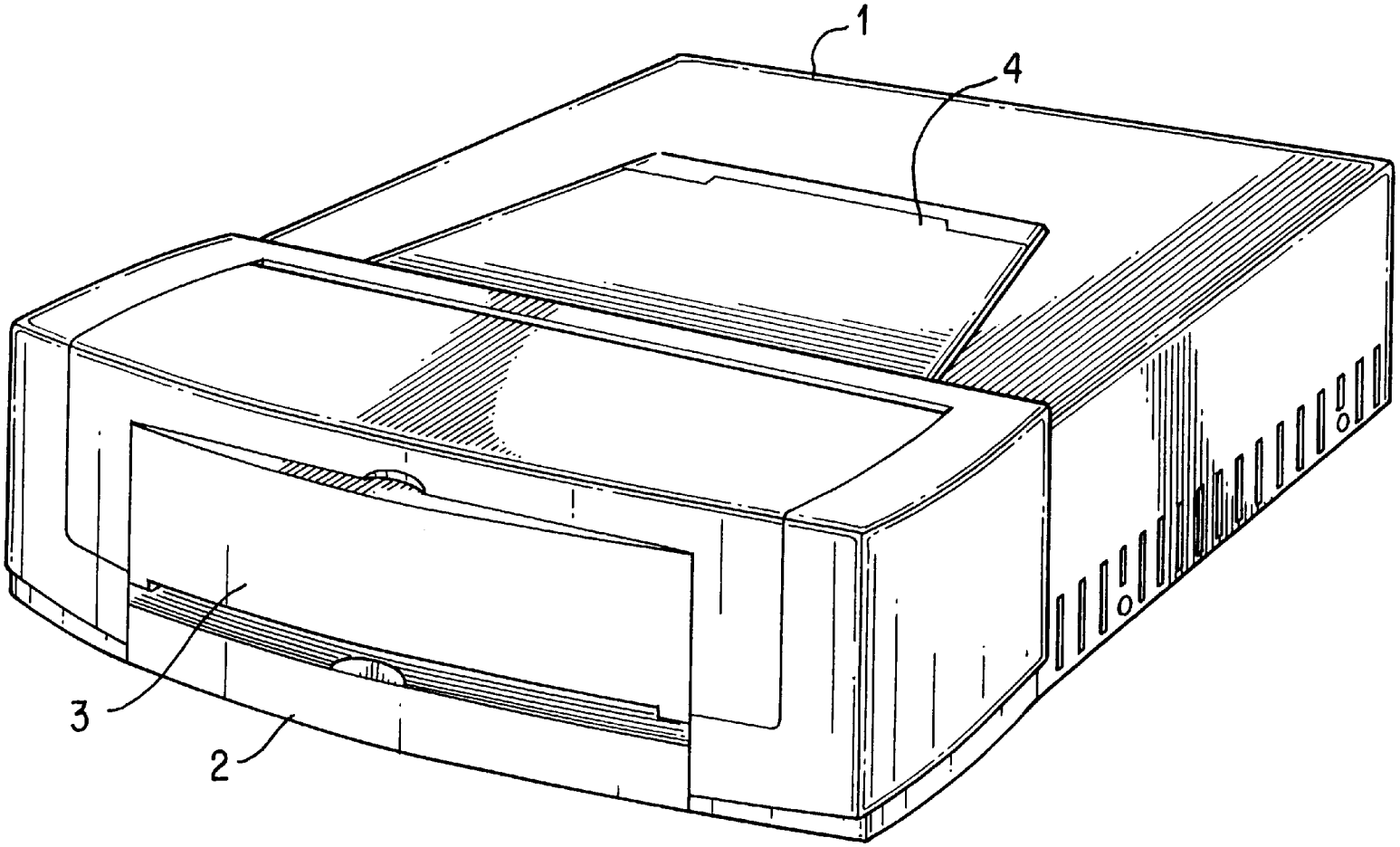
FIG. 1 is a perspective view of a low profile printer.

With reference to the drawings, FIG. 1 shows a low profile printer 1 including a paper supply tray 18, (not shown in FIG. 1 but illustrated in FIGS. 5 and 6), and a paper output tray 2. Both the paper supply tray 18 and the paper output tray 2 are coupled to the printer 1 to permit input and output of sheets of paper 14. Above the paper trays is a single sheet feed door 3. The top of the printer has an access door 4 for clearance of paperjams and the like when entry to the interior of the printer 1 is required. While this invention is described in terms of paper and paper sheets, it is intended that the invention encompass any sheet material which may be handled as individual or continuous sheets of such sheet material.

Figure 2:
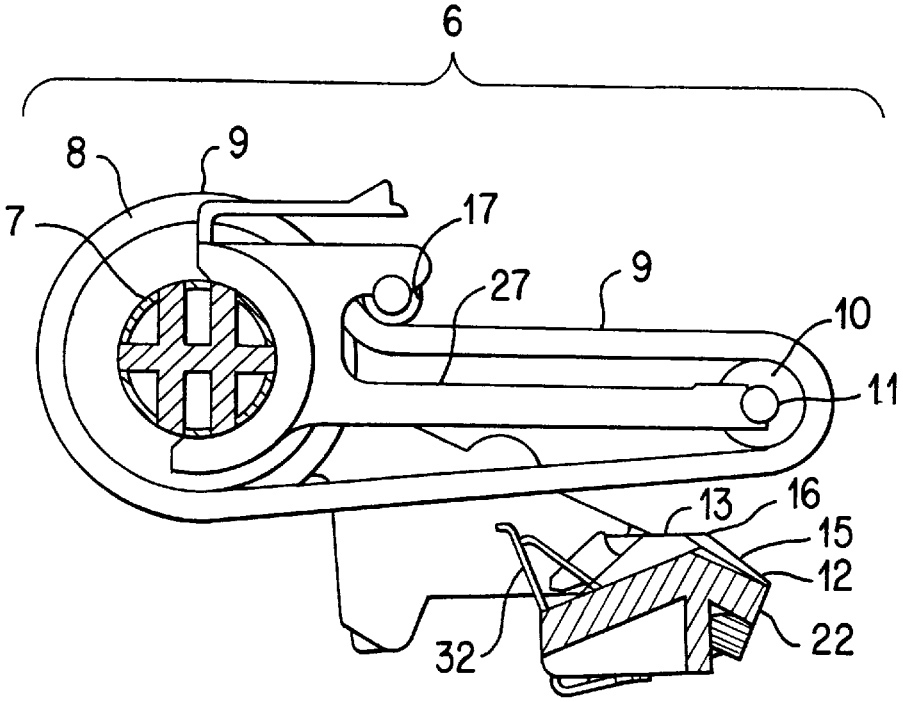
FIG. 2 is a side sectional view of the continuous belt with the paper in the paper tray and the separator pad biased against the belt.

FIG. 2 shows a paper feed apparatus 6 including a paper feed drive shaft 7 adapted for selective rotation under control of a printer controller or electronics (not shown). the printer 1 electronics. The paper feed drive shaft 7 supports a belt drive pulley 8. The belt drive pulley 8 engages a continuous belt 9 mounted thereon which may be rubber or other flexible belt material. The opposite end of the continuous belt 9 is mounted to an idler roller 10, mounted on an idler shaft 11, which supports the continuous belt 9 such that the portion of the belt 9 which engages a sheet of the paper 14 is disposed generally parallel to a path of the paper 14.

Figure 3:
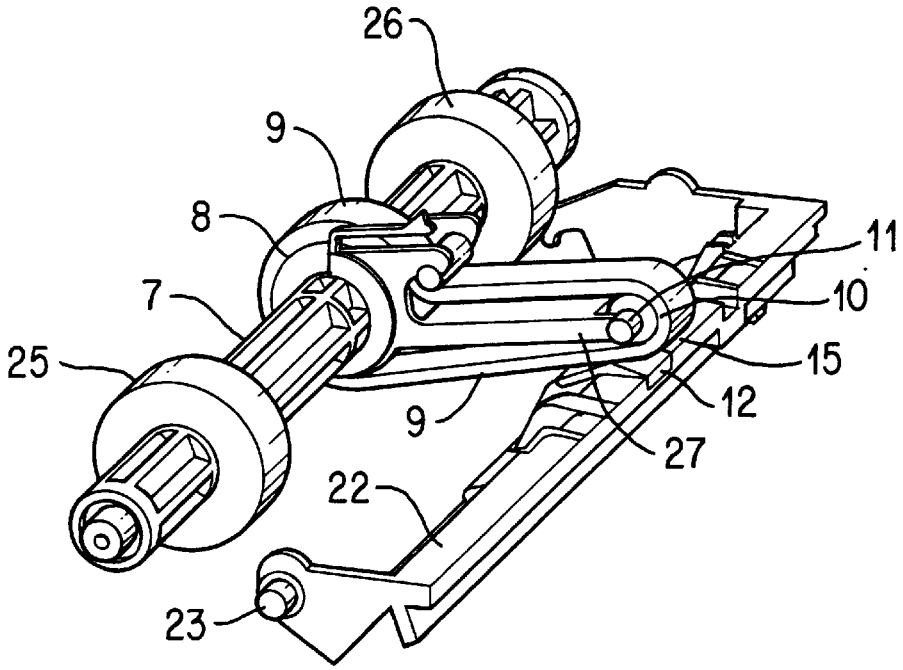
FIG. 3 is a perspective view of the paper feed apparatus with the separator pad biasing the separator pad against the belt.

The belt 9 is preloaded to a belt frame 27 to keep the system stable, that is, to retain the belt 9 and supporting mechanism, i.e. pulleys, rollers and shafts, in place and to maintain that portion of the belt 9 which is in contact with a sheet of paper 14 in a generally parallel disposition to the path of the paper 14. Approximately, two to four pounds of preload is applied by appropriate selection of dimensions of the pulley and roller placement, belt width, belt elasticity and circumference of the belt 9. Preload is the tension applied by the stretch of the belt against the various pulleys which biases them against their mounting structure to hold them in place. Selection of the proper preload amount is dependent on the type of material from which the belt is made and the extent to which the stretch in the material may relax over time. As shown in FIG. 3, the belt 9 is substantially less in width than the paper 14 to be fed as defined by the width of the separator pad frame 22.

The preferred embodiment utilizes a belt 9 which is approximately 13 mm wide and 2 mm thick which is significantly smaller than standard paper sizes. The particular size of the belt 9 is determined by the particular implementation. To minimize forces in the system the belt 9 width should be less than the width of the paper.

Positioned below the belt 9 is a separator 12. The separator 12 has an inclined side 13 for receiving sheets of paper 14 fed by belt 9. However, the angle of attack of the inclined portion is not critical but must be greater than 0 degrees and less than 90 degrees relative to the surface of the belt 9 when the separator 12 is biased against the belt 9.

The top portion of the separator is covered by a pad 15 which is of similar material to the belt 9. Regardless of the material used for the belt 9 and the separator pad 15, the belt 9 material and the separator pad 15 should each have a sufficient coefficient of friction when in contact with the sheet of paper 14 to prevent relative movement between the belt 9 and the paper 14 biased into in contact with the belt 9 or pad 15 on one side and against another sheet of paper 14 on the other side.

The friction of the belt 9 against a sheet of paper 14 should be sufficient to overcome the friction of that same sheet which is also in contact the separator pad 15 at the point where the inclined section of the separator pad 15 merges into an arcuate crown at the point of contact with the belt at NIP 16 so that a single sheet of the paper 14 may be moved through the NIP 16 and over the separator pad 15 to the grit wheel (not shown) when the belt moves so as to convey the paper to the printing station or other downstream processor.

Silicon rubber or EPDM rubber having a Shore hardness of approximately 40 for the belt 9 and approximately 60 for the separator pad 15 is suitable. Other hardness factors may also be suitable dependent on the material and structure used. In fact many materials exhibit different coefficients of friction under different conditions such as changes in temperature, where generally higher temperatures represent a higher coefficient of friction. In addition, certain materials represent different coefficients of friction when in contact with different types of materials. The addition of plasticizers to rubber also modifies the friction characteristics. However, the coefficient of friction of the belt 9 against the paper 14 should be higher than the coefficient of friction of the pad 15 against the paper 14.

The instant invention utilizes EPDM rubber for reduced cost although Silicon may provide better separation. Generally, the greater the hardness the lower the coefficient of friction of the rubber.

Figure 4:
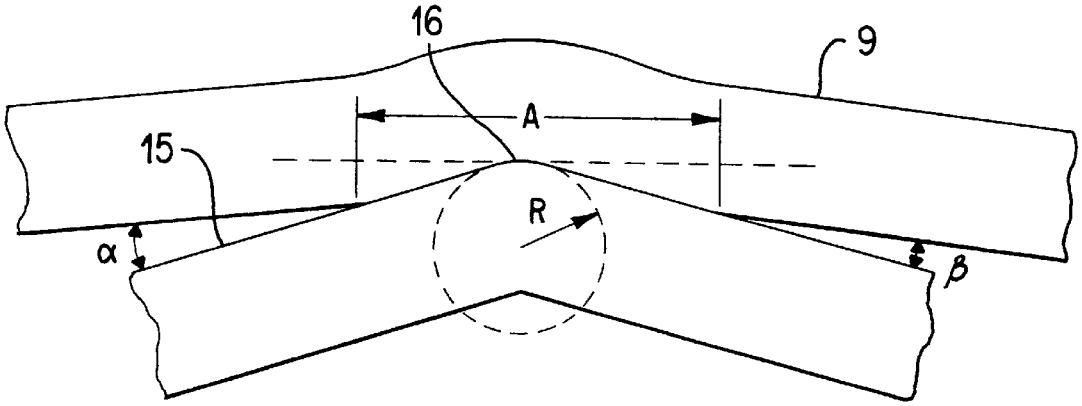
FIG. 4 is a side view schematic of the separator pad belt illustrating an area of overlap.

The paper separator 12 is mounted between the first drive pulley 8 and the idler roller 10 such that the NIP 16 of the separator pad 15 is overlapped slightly by the belt 9 due to the belt 9 elasticity thereby forming a separation region "A" as shown in FIG. 4. In FIG. 4, the leading inclined portion of the separator pad 15 forms an angle α with the paper path (the run of the belt 9 prior to bias shown as a dotted line) of approximately 17 degrees. The declined section of the separator pad 15 forms an angle β with paper path of approximately 21 degrees. The arc of the separator pad 15 at the NIP 16 forms an arcuate path of radius R of 2.5 mm connecting the surface of the inclined and declined slopes of the separator pad 15. The degree of overlap forming the separation region is determined by the arc of the separator pad 15 at the NIP, 16, and the amount of bias pressure of the separator 12 and the separator pad 15 against the belt 9.

The arc in the instant invention is determined by curve fitting techniques but in the preferred embodiment is generally an arc having a radius of approximately 2.5 mm. Different arcs will result where different angles of the inclines are involved. The passage of the belt 9 over the separator pad 15 causes a slight compression in the belt 9 at the NIP 16 and a slight arc in the belt 9 as it passes over the NIP 16.

Significant bias pressure on the separator pad 15 increases the amount of overlap of the belt 9 but has little effect on the movement of the paper through the NIP 16. The minimum bias pressure is approximately 10 grams. The most desirable pressure is 15 grams or greater. This overlap creates the separation region A as shown in FIG. 4. A pressure that causes a maximum overlap which covers the entire pad is unnecessary and any pressure which exceeds the maximum overlap is excessive.

The separator 12 and separator pad 15 are selectively biased against the continuous belt 9 at a point on the belt 9 between the feed drive pulley 8 and the idler roller 10 at the NIP 16 of the separator pad 15. The separator 12 upon which the separator pad 15 is mounted is coupled to the paper tray 18 and is moved into position when the paper tray 18 holding the paper 14 is biased against the belt 9. However, it is clear that the separator 12 may be moved independent of the paper tray 18 and the separator pad 15 independently biased against the belt 9 as selected. It is preferred that the bias be engaged only when there is a page of the paper 14 moving through the paper path to minimize wear. Accordingly, the separator pad 15 and paper 14 are biased against the belt 9 at the same time.

The specific embodiment also includes a bias roller 17 which is biased against the upper portion of the continuous belt 9 to configure the belt 9 run to fit into a restricted area of the printer. Various other configurations, roller and pulley sizes may be utilized dependent on the type and style of printer used and this invention is not intended to be restricted to the specific embodiment disclosed or the relative pulley or roller sizes.

The bias roller 17 and the idler roller 10 are held in circular recesses in the belt 9 frame 27 by the preload of the belt 9 and do not require circular holes for the axles of the rollers. This allows ease of assembly.

It should be noted in FIG. 3 that the belt 9 and the separator pad 15 are more narrow than the paper 14 width to minimize frictional forces when the belt is engaged and paper movement commences. While the preferred width of the belt 9 and the separator pad 15 is 13.3 mm, the scope of the invention is not to be so restricted. As the width of the belt 9 increases, a greater amount of friction is spread over the paper at the NIP 16. This requires a change in the bias forces in the system which must be adjusted to compensate for the change in width. Also shown in FIG. 3 are a pair of paper rollers 25 and 26 and the separator frame 22 upon which the separator pad 15 is mounted.

Multiple belt 9 and pad 15 combinations may be employed if greater motive and separation force against the paper or other sheet material is required.

Other paper engagement devices such as a grit wheel (not showing) or other high friction devices, as is known in the art, are mounted in the paper path after the paper separator pad 15 position to receive the paper 14 which is pulled through the NIP 16 to engage the grit wheel (not shown) or other paper collecting device (not shown) and fed to the printing station or other processing stage.

The printing station may be included in any continuous, incremental, flat bed, thermal, ink, impact or other printing device as is know in the art or which may be used in the future. The particular technology used to effect printing on the paper is not the subject of this invention as any technology may be used. Similarly, while a sheet paper feed device is described, continuous fold or rolled paper or other sheet material could be used. Manual and continuous sheet feeding operation is also contemplated as within the scope of this invention.

The paper feed apparatus 6 is operatively engaged with a motive apparatus which may be used for operating the other moveable parts of the printer, copier or other printing device, and includes an electric motor stepper motor or the like under control of the printer electronics which operate the printer so that the belt 9 may be selectively moved, stopped or reversed as required. The interconnection of a driving apparatus in copiers and printers is well known and need not be described in detail.

Figure 5:
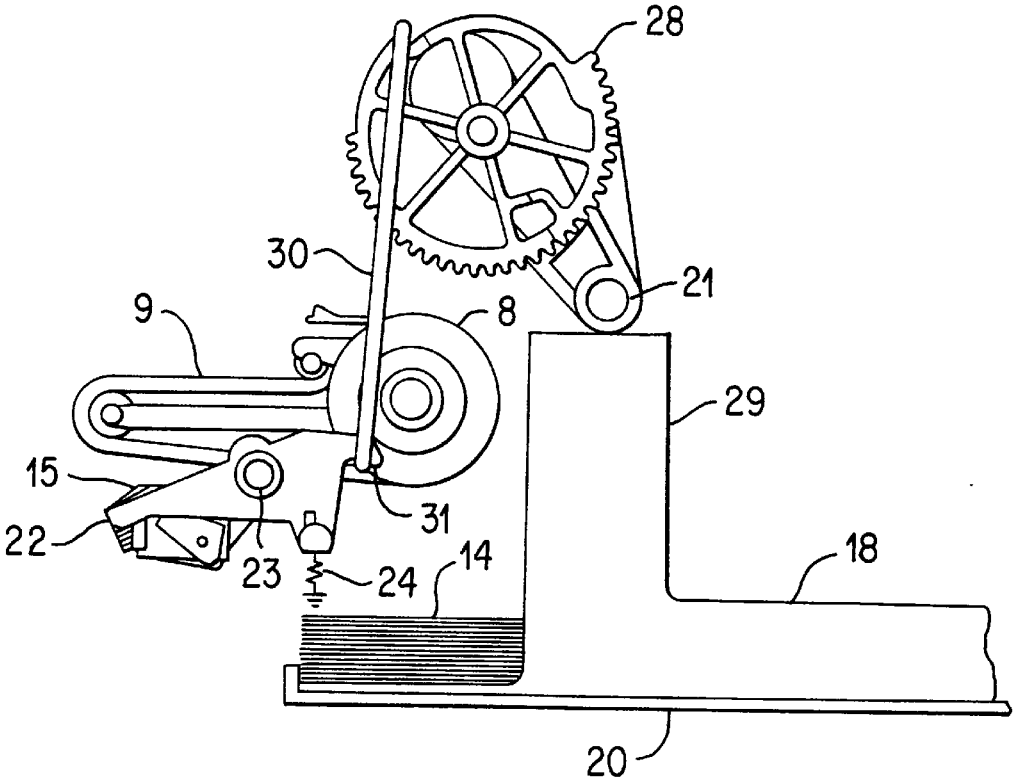
FIG. 5 is a side view of the paper tray and the separator pad held in an unbiased position away from the belt.

As noted in FIG. 5, the paper 14 supply is mounted in the printer such that the paper 14 may be biased against the belt 9. This may be accomplished by utilizing a paper tray 18 which is selectively biased against the belt 9 by a spring 19 loaded against the bottom of the paper tray 18 which biases the tray upwards and away from bottom of the paper reservoir 20 during a paper feed cycle. When the paper 14 is not biased against the belt 9, it may be held in a non-biased position by a cam 21 or solenoid or other suitable arrangement. FIG. 5 shows the cam 21 retaining paper tray 18 in the nonbiased position, that is out of contact with the belt 9. Cam 21 is rotated downward on rotation of the gear wheel 28. In FIG. 5 when gear wheel 28 rotates in a clockwise direction, cam 21 engages the frame 29 of tray 18 and holds the tray in the unbiased position against the force of the spring 19.

Spring 19 is positioned to bias the tray 18 against the belt 9 when unrestrained. In addition, a link 30 on the opposite side of a gear wheel 28 is attached to the separator frame 22 at a link tab 31. On clockwise rotation of the gear wheel 28, the link 30 pulls the leading edge of frame 22 upwards and causes the frame 22 to rotate about a pinion 23 which pulls the separator pad 15 away from contact with the belt 9.

Figure 6:
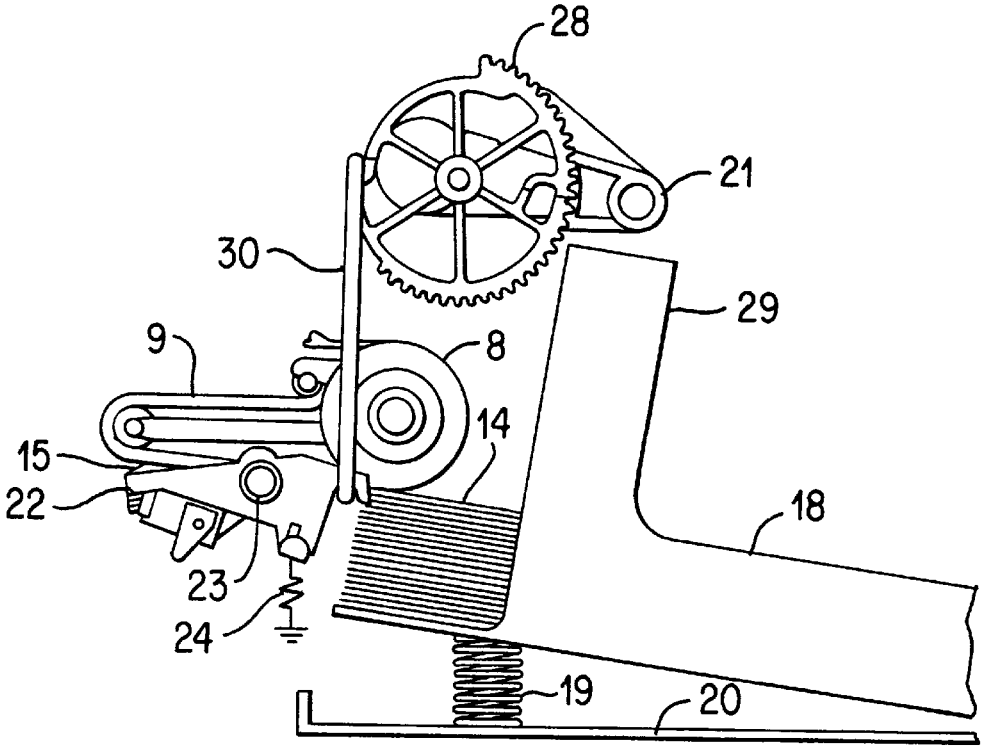
FIG. 6 is a side view of the paper tray and the separator pad biased against the belt.

FIG. 6 shows the bias position of the elements described above. When gear wheel 28 rotates in a counter clockwise direction, cam 21 disengages from the frame 29 of paper tray 18 and the spring 19 biases the moveable tray 18 toward the belt 9 and places the first page of the individual sheets of paper 14 in contact with the belt 9. Similarly, on clockwise rotation of the gear wheel 28, link 30 on the opposite side of the gear wheel 28, allows the separator frame 22 spring 24 (shown attached to the separator 12 frame 22 and to mechanical ground opposite the separator pad 15 such that contraction of the spring 24 causes rotation of the frame about pinion 23) to pull the leading edge of frame 22 downwards and causes the frame to rotate about the pinion 23 and places the pad 15 into contact with the belt 9.

Figure 7B:
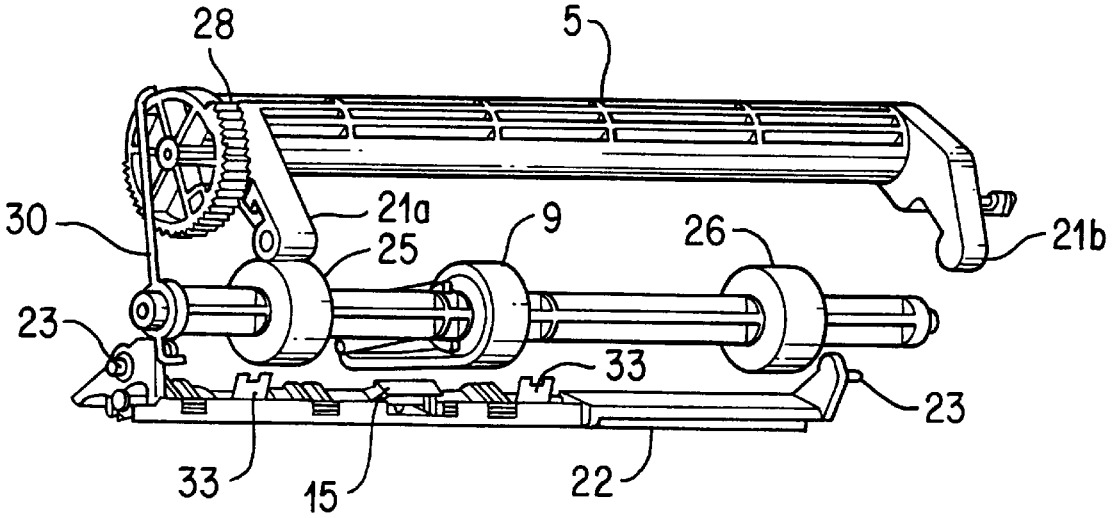
FIG. 7B is a perspective view of the belt with the separator in an unbiased position and the kicker plate in the paper return position.

As noted in FIG. 7B there are two cams 21*a* and 21*b* which engage respective sides of paper tray frame 29. These cams are mounted on a torque bar 5 and connected to the gear wheel 28. Only one link 30 is provided to operate the paper separator 12 frame 22. When the continuous belt 9 is activated on rotation of the paper feed shaft 7, the top sheet of paper 14 is pulled from the paper tray 18 and pulled along the paper path it reaches the separator pad 15. Additional misfed sheets of paper 14 beneath said top sheet may be pulled along by the top sheet due to friction between sheets. Bias of the separator 12 and therewith the separator pad 15 against the belt 9 is accomplished in a manner similar to that of the paper 14 tray.

As shown in FIG. 3 the separator 12 is mounted on a frame 22 which is rotatably attached to the housing of printer 1 through pinions 23. The frame 22 is biased to rotate into the belt 9 by a spring 24 as shown in FIG. 5. When in an unbiased position, the frame 22 is restrained in a non-biased portion by the link 30 and or other selectively engaging apparatus such as a solenoid or the like until bias is required.

The cam 21 restraining the paper tray and link 30 restraining the separator 12 frame 22 may be ganged to operated together as shown. Continued movement of the belt 9 will cause the leading edge of each misfed lower sheet of paper 14 to engage the incline 13 of the paper separator pad 15. The friction of each lower misfed sheet of paper 14 against the separation pad 15 in the separation region is greater than the friction between it and any upper sheet which causes each lower sheet of paper 14 to cease moving along with the top or other upper sheet of paper 14 and the belt 9. The sheets of paper 14 then fan out along the incline 13 which the lowermost sheet of paper 14 ceasing movement first and each subsequent sheet of paper 14 engaging the separator pad 15 in sequence. Maximum friction of the belt 9 against the top sheet 14 which is in contact with the belt 9 along its length is, however, maintained and the top sheet of paper 14 continues to move through the NIP 16 toward the grit wheel (not shown) and overcomes the friction of the pad 15. This action causes the top most sheet of paper 14 to be separated from any sheets of paper 14 below said top sheet of paper 14 and thus a single sheet of paper 14 is fed to the grit wheel (not shown) or the like for further processing in the printer.

Figure 7A:
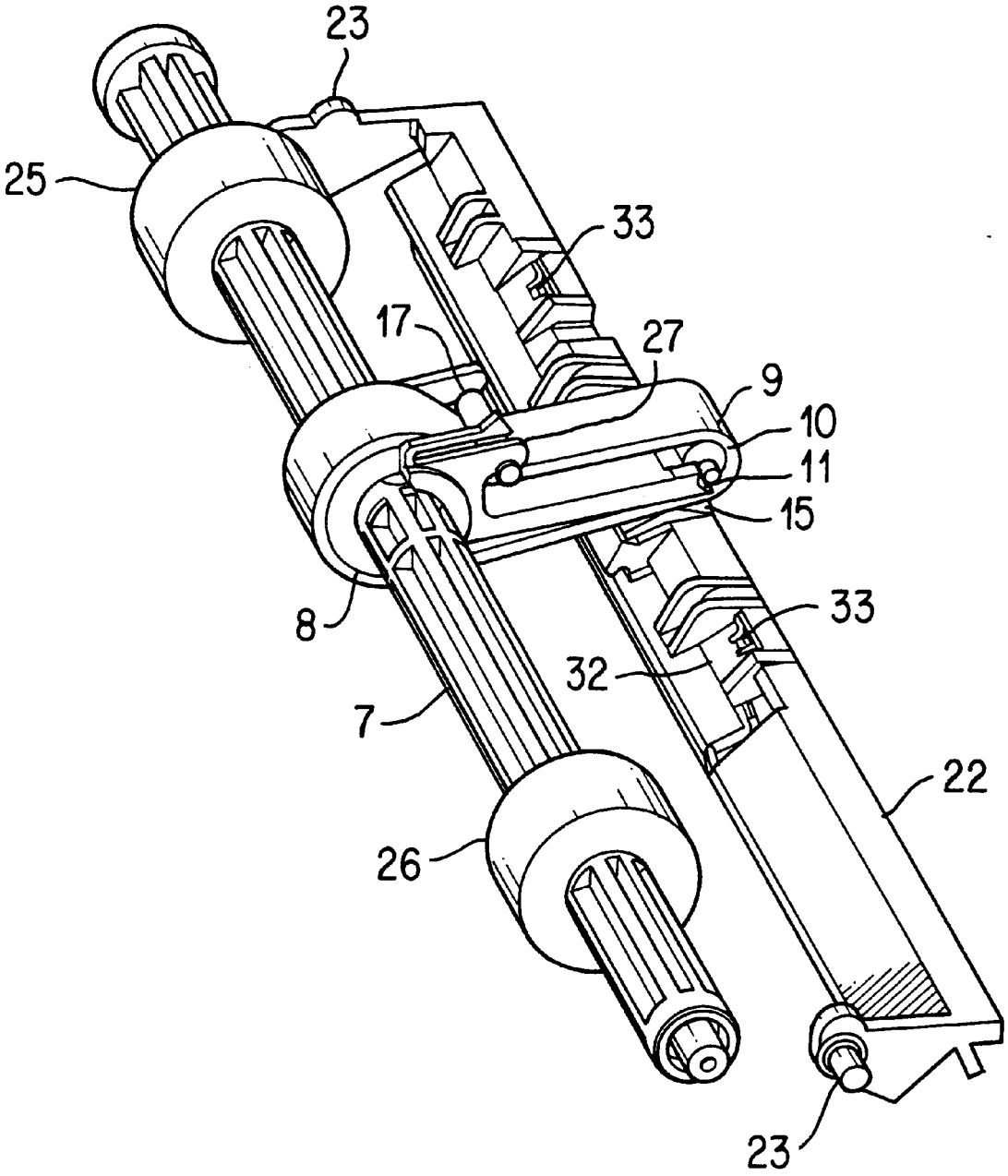
FIG. 7A is a perspective view of the belt with the separator in a biased position and the kicker plate in the retracted position.

FIG. 7A and 7B illustrate the action of a kicker plate 32. The kicker plate 32 is mounted to a frame 22. When frame 22 is in the biased position as shown in FIG. 7A the kicker plate 32 is recessed into receptacles in frame 22. When frame 22 is in the non-biased position, kicker plate 32 rotates away from the frame 22 and toward the paper tray 18. Two kicker plate fingers 33 engage the edge of any sheet of paper 14 which was misfed and throws the paper 14 back into the paper tray 18 as shown in FIG. 7B which is a view from the paper tray 18 position.

Figure 8:
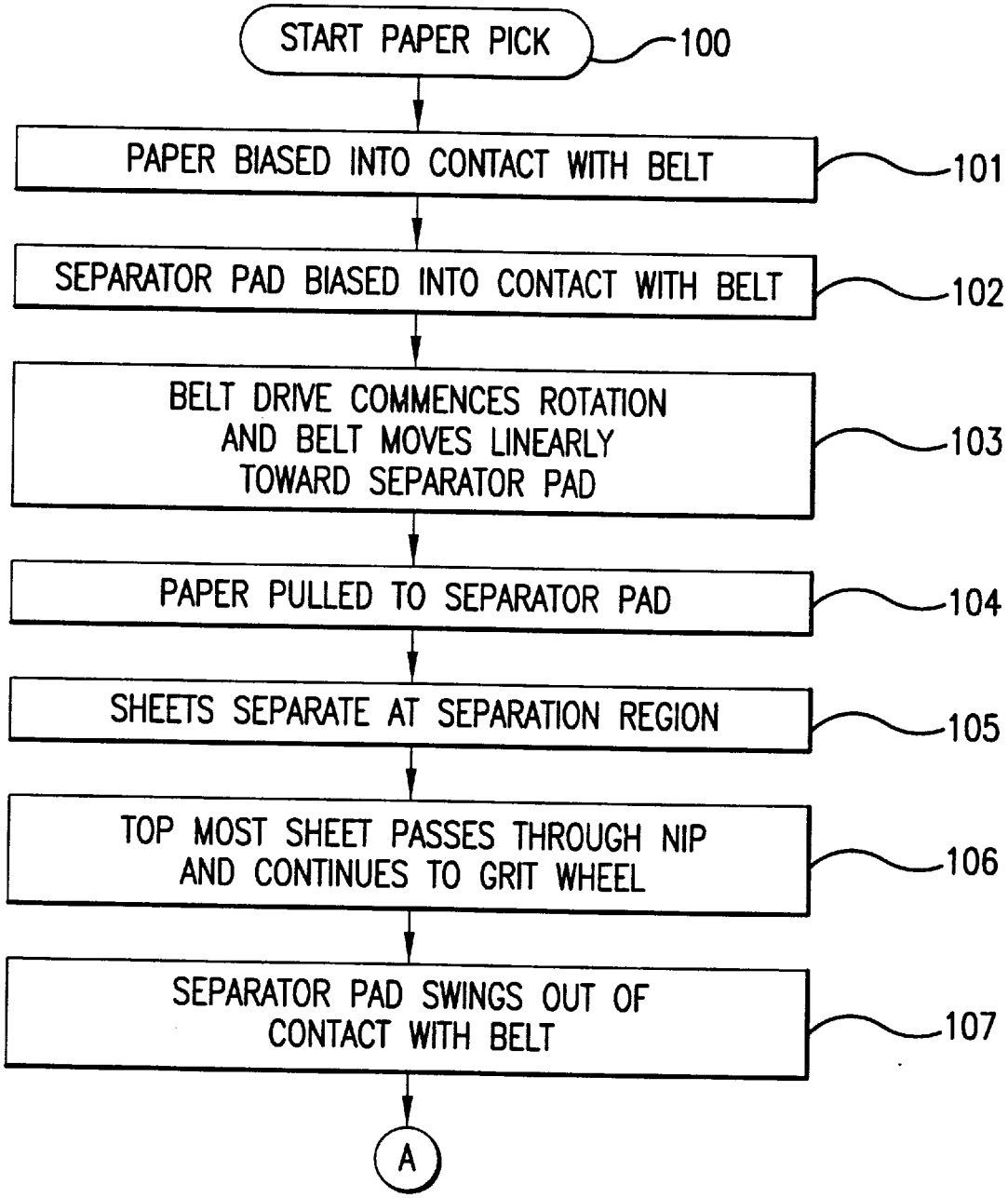
FIG. 8 is a flow diagram of the feeding operation with a kicker plate.
Figure 9:
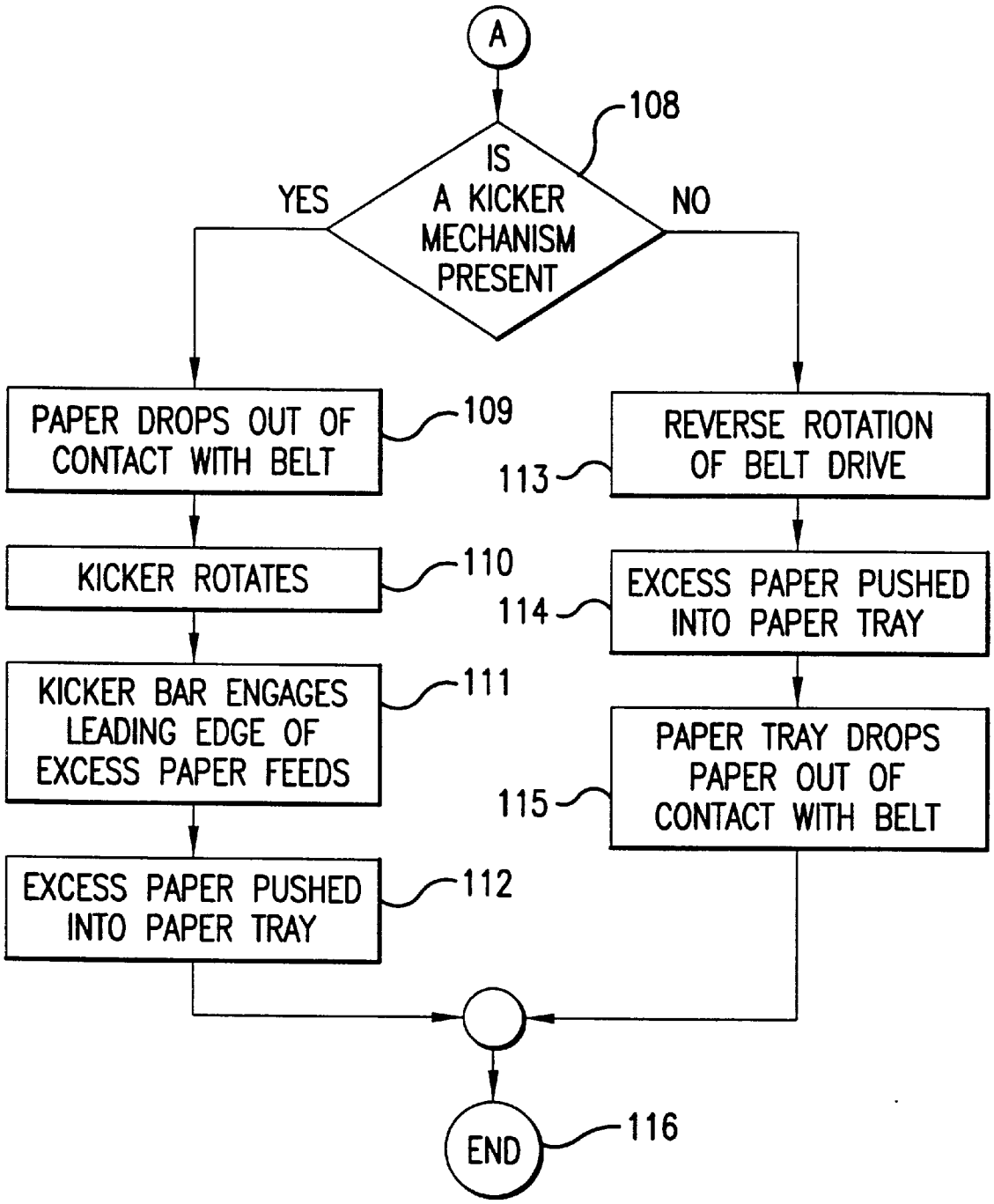
FIG. 9 is a flow diagram of the feeding operation with belt reversal.

FIGS. 8 and 9 illustrate the sequence of events or steps for feeding and separating the sheets in the instant invention. With reference to FIG. 8, a paper pick step 100 commences with the biasing the paper 14 against the belt 9, as described above. A bias contact step 101 occurs with the sheet of paper 14 making contact with the belt 9 to facilitate moving the sheet of paper 14 from the tray 18. A separator 12 contact step 102 is initiated by moving the separator pad 15 into contact with the belt 9 at the NIP 16. A belt 9 movement step 103 commences on movement of the belt 9. A pulling step 104 pulls the paper 14 from the paper supply toward the separator pad 15. Before the belt 9 travels the length of the paper 14, the paper should be biased away from the belt 9 to prevent pile up of subsequent sheets.

The dimensions of the belt 9 run are smaller than the paper 14 length such that when the upper sheet of paper 14 has reached the grit wheel (not shown) and is being pulled out of the separation region, the upper sheet trailing edge is still in contact with the belt 9. This prevents premature contact between the belt 9 and any subsequent sheets of paper 14.

The sheet of paper 14 immediately adjacent the belt 9 (the top most sheet) is continuously pulled through the separator pad 15 in a continuous pulling step 104. If multiple sheets 14 have been pulled they separate over the inclined portion 13 of the separator pad 15 and all but the uppermost sheet of paper 14 is separated at the NIP 16 in a separation step 105. The top most sheet of paper 14 continues through the NIP 16 into the grit wheel (not shown) in a step 106 and the separator frame 22 along with the separator pad 15 is rotated away from contact with the belt 9, in a pad disengaging step 107. If a kicker plate 32 is present at a step 108, the paper 14 biased against the belt 9 drops out of contact with the belt 9 at a paper 14 disengaging step 109.

When the separator pad 15 is rotated out of contact with the belt 9, the motion of the frame 22 causes the kicker plate 32 to rotate towards any excess fed sheets of paper. The kicker plate fingers 33 engage the edges of the excess paper 14 which remains in the paper path and the kicker plate fingers 33 push the paper 14 back into the paper tray 18 in a paper return step 112, as shown in FIG. 7A and 7B.

Alternatively, where no kicker plate 32 is used, the supply of paper 14 in the tray 18 must remain biased against the belt 9 until the upper most sheet of paper 14 has cleared and the direction of the belt 9 reversed in a belt reversal step 113, which returns excess sheets of paper 14 to the paper tray 18 in a return step 114. The paper 14 refers to a single sheet of paper, and more specifically to the top sheet of paper in the stacked supply. Excess sheets of paper 14 refer to misfed sheets other than the top most sheet of said paper 14.

After the excess sheets of paper 14 are returned in the return step 114, the paper tray 18 drops out of contact with the belt 9 in a paper tray disengaging step 115 and the feed cycle ends at a step 116.

In fact, the multi-fed sheets need not be returned to the tray 18 as they will not interfere with the operation of the printer. However, removal of the paper tray 18 at any time would leave behind such misfed sheets in a partially feed position if they had not already been used and may then create a problem which does not exist when the paper is returned fully to the paper tray 18. Such a problem can occur if the paper tray is removed and reinserted. excess sheets may remain in the printer and bejammed into the printer on return of the paper tray 18.

Other advantages, features and applications of this invention will be apparent to those skilled in the art and are considered to be within the scope of this invention and this invention Is not intended to be limited to the specific embodiment disclosed.

Having thus described the invention what is claimed is:

1. A sheet feed apparatus for moving a stack of individual sheets of print medium in seriatim from an input tray to an output tray for sheet printing purposes, comprising:

at least one motor driven continuous belt for engaging a top print medium sheet in the stack with a sufficient frictional force to pull said top print medium sheet into a sheet fed path;

said sufficient friction force cooperating with another frictional force between the individual sheets of print medium in the stack of sheets to cause groups of sheets below said top print medium sheet to misfeed into said sheet fed path with said top print medium sheet;

a fanning arrangement disposed in said sheet fed path and partially in contact with said belt during selective periods of time for supporting from below said top print medium sheet and said group of misfed sheets as they travel along said sheet fed path;

said fanning arrangement having an inclined friction pad surface with a sufficient coefficient of friction for retarding individual ones of the print medium sheets in said group of misfed sheets to fan them out along said sheet fed path but not a sufficient coefficient of friction to retard said top sheet so that it is fed along said sheet fed path into a normal interface point where said belt and the surface of said friction pad contact one another for further sheet feeding purposes;

a rotatable frame for helping to selectively disengage said belt and said friction pad surface from one another as said top sheet passes through said normal interface point to facilitate in seriatim sheet feeding of the top sheet and the fanned out sheets as each subsequent sheet in the misfed group is subsequently selectively engaged by said belt and pulled into said normal interface point; and a kicker plate mounted to said frame and having a set of fingers for rotating into said sheet fed path to engage any excess print medium sheets in said group of misfed sheets to push them back into the output tray.

2. A sheet feed apparatus according to claim 1, wherein said group of misfed sheets is selectively biased into contact with said continuous belt sheet by sheet to facilitate in seriatim feeding of individual ones of the sheets in said group of misfed sheets.

3. A sheet feed apparatus according to claim 1, wherein said belt comprises a material having a surface friction sufficient to overcome the friction between said top sheet and at least one subsequent sheet disposed on the under side of said top sheet opposite said belt and to move said top sheet on movement of said belt.

4. A sheet feed apparatus according to claim 3, wherein said fanning arrangement further comprises:

a block having an inclined portion on one side thereof disposed toward the input tray and inclined away from input tray and toward said belt having a surface of sufficient friction to overcome friction between any first sheet immediately adjacent said belt on one side and any subsequent sheets adjacent to the first sheet on the opposite side of the first sheet when any subsequent sheet is engaged by said fanning arrangement and the first sheet is moved by said belt.

5. A sheet feed apparatus according to claim 4, wherein said surface further comprises a layer of rubber.

6. A sheet feed apparatus according to claim 4, wherein said inclined portion receives a portion of said belt overlaying a separation region formed between said belt and said surface when said fanning arrangement is biased against said belt.

7. A sheet feed apparatus according to claim 1, wherein said fanning arrangement includes a block having an inclined surface with a friction pad attached to at least part of said inclined surface to provide a friction surface.

8. A sheet feed apparatus according to claim 7, wherein said friction pad includes a layer of friction material covering at least part of said inclined surface and at least part of an arcuate section of said block.

9. A sheet feed apparatus according to claim 8, wherein the arcuate section of said block covered by said friction pad is selectively biased into contact with at least a portion of said belt forming at least part of a separation region.

10. A sheet feed apparatus according to claim 7, wherein said block includes a declined section; and wherein said pad covers at least a part of said inclined section, said arcuate section and at least a part of said declined section.

11. A sheet feed apparatus according to claim 1, wherein the top sheet is selectively biased into contact with said belt and said belt engages said top sheet on one side of said top sheet for movement purposes.

12. An individual sheet feed apparatus according to claim 11, wherein said belt comprises a material having a surface friction sufficient to overcome the static friction of said top sheet in the input tray and move said top sheet on movement of said belt.

13. An individual sheet feed according to claim claim 1, wherein said fanning arrangement is immediately adjacent said belt for selectively engaging it and the top sheet and any subsequent sheet disposed on the under side of the top sheet opposite said belt which are moved with the top sheet and engaging the leading edge of the top sheet and each subsequent sheet for preventing subsequent sheets from movement with the top sheet.

14. A sheet feed apparatus according to claim 13, wherein said fanning arrangement includes:

an inclined surface having a pad overlying it, said pad having a surface friction sufficient to overcome static friction between top sheet and any subsequent individual sheet on the stack.

15. A sheet feed apparatus according to claim 14, wherein said pad forms a linear section covering at least part of said inclined surface and overlaps an arcuate section of the inclined surface at a point of engagement with said belt.

16. A sheet feed apparatus according to claim 15, wherein said pad covering said arcuate section selectively engages a portion of said belt forming a separation region.

17. An individual sheet feed apparatus according to claim 16, wherein the surface of said pad comprises a layer of rubber.

18. A method of feeding a stack of individual sheets of print medium in seriatim from an input tray to an output tray for sheet printing purposes, comprising:

engaging a top print medium sheet in the stack with a continuous belt having a sufficient frictional force to pull said top print medium sheet into a sheet fed path;

applying another frictional force between the individual sheets of print medium in the stack of sheets sufficient to cause groups of sheets below said top print medium sheet to misfeed into said sheet fed path with said top print medium sheet;

pulling the groups of sheets and said top print medium sheet along an inclined portion of said sheet fed path;

engaging a lower surface portion of the groups of sheets and said top sheet with a friction pad disposed along a portion of said inclined path, said friction pad having a sufficient coefficient of friction to retard the forward motion of individual ones of the print medium sheets in said groups of sheets to fan them out along said sheet fed path but not a sufficient coefficient of friction to retard said top print medium sheet so that it is fed along said sheet fed path into a normal interface point where said belt and said pad contact one another for further sheet feeding purposes;

selectively disengaging said belt and said pad from one another as said top sheet passes through said normal interface point to facilitate in seriatim sheet feeding of the top sheet and the fanned out sheets as each subsequent top sheet in the misfed group is subsequently engaged selectively by said belt and pulled into said normal interface point; and pushing any excess print medium sheets in said group of misfed sheets rearwardly along said sheet fed path a sufficient distance to return them to the output tray.

19. The method of claim 18 further comprising:

selectively biasing the stack of individual sheets of print medium against said belt drive such that said top sheet is frictionally engaged by said belt;

moving at least part of said belt and said top sheet in a generally parallel direction to said sheet fed path;

stopping belt movement when said top sheet is disengaged from said belt; and removing the stack from the bias engagement against said belt after said belt is stopped.

20. The method of claim 19 further comprising:

selectively biasing said friction pad against said belt prior to engagement of said top sheet by said pad; and removing said bias of said pad against said belt after said belt is stopped.

* * * * *